US005445102A

United States Patent [19]

Rupp

[11] Patent Number: 5,445,102

[45] Date of Patent: Aug. 29, 1995

[54] FISHING BOAT OUTRIGGER DEVICES

[76] Inventor: Herbert E. Rupp, 4761 Anchor Ave., Port Salerno, Fla. 33692

[21] Appl. No.: 937,179

[22] Filed: Aug. 31, 1992

[51] Int. Cl.[6] ..... B63B 35/14

[52] U.S. Cl. ..... 114/255; 43/27.4

[58] Field of Search ..... 114/255, 364; 403/407.1, 245, DIG. 8, 348, 368, 374, 364, 409.1; 43/21.2, 27.4; 248/512, 513, 538, 539, 540, 541

[56] References Cited

U.S. PATENT DOCUMENTS

| | | | |
|---|---|---|---|
| 2,794,191 | 6/1957 | Gaskouitz | 114/364 |
| 3,229,791 | 1/1966 | Soman | 403/409.1 |
| 3,874,627 | 4/1975 | Vaught | 403/409.1 |
| 4,596,484 | 6/1986 | Nakatani | 403/374 |
| 4,632,050 | 12/1986 | Rupp | 114/255 |
| 4,726,703 | 2/1988 | Ashley | 403/368 |
| 4,993,346 | 2/1991 | Rupp | 114/255 |
| 5,191,852 | 3/1993 | Rupp | 114/255 |

*Primary Examiner*—Stephen Avila
*Attorney, Agent, or Firm*—Carroll F. Palmer

[57] ABSTRACT

An outrigger device for use on a fishing boat upon which it is mounted for both lateral movement, e.g., between trolling and stowage positions, and vertical movement, e.g., between vertical and horizontal, includes an outrigger pole receptacle tube, a mount unit including a plate for attachment to the boat, a standard tube that extends upwardly through and rotates in a central opening in the plate, a pivot unit fixed to the top end of the standard tube that mounts the receptacle tube to said standard tube for angled positioning between the two and a bifurcated, cam operated lock unit that surrounds the standard tube and is carried on the plate for controlling rotation of the standard tube relative to the plate.

18 Claims, 3 Drawing Sheets

MS
MS

FISHING BOAT OUTRIGGER DEVICES

BACKGROUND OF THE INVENTION

1. Field of the Invention

This application relates broadly to fishing equipment. More particularly, it concerns outrigger devices for use with fishing boats.

2. Description of the Prior An

In sportfishing operations, a conventional procedure is to troll fishing lines astern of the fishing boat from outrigger devices that hold the lines spaced apart a sufficient distance to prevent them from becoming entangled with one another due to the movement of the boat or the action of the sea.

Typically, each outrigger device includes an elongated tubular unit, e.g., 10–30 ft. long, having its inboard end fastened in some manner to the fishing boat so that it can be moved from a stowage position while the boat is not actually engaged in fishing, e.g., underway to or from the fishing grounds, to a trolling position while the boat is engaged in fishing.

On large, offshore type sportfishing boats, the outrigger devices are typically of the tubular, cable-trussed, mast type pivoted by their inboard ends upon a vertical portion of the cabin or other boat superstructure and have associated boom elements to enable the outrigger to be firmly held in the stowage or trolling position while permitting easy movement between such separated positions (see U.S. Pat. Nos. 4,632,050 & 4,889,064).

On smaller fishing boats, often powered by outboard motors, the outrigger devices are less complicated than the tubular mast type used on the offshore, sportfishing boats. Typically, such outriggers comprise only a single piece of tubing, often tapered, pivoted by the inboard end to the gunwale or equivalent horizontal surface of the boat (see U.S. Pat. No. 3,008,259).

One style of the smaller fishing boats that is very popular because the layout of such boats provides a large area of cockpit sole for use by boat occupants during fishing, is the so-called "center console" type. An improved form of outrigger device for use with such motorboats equipped with T-tops has been developed (see U.S. Pat. No. 4,993,346).

The present invention further advances the art of outrigger design by providing outrigger devices of relatively simple construction particularly useful on sportfishing boats of the 20–30 foot type.

OBJECTS

A principal object of the invention is the provision of new forms of outrigger systems for use with fishing boats.

Further objects include the provision of:

1. Sportfishing boat outrigger devices that are easy to operate, tough and dependable.

2. Such devices having lever action locking to provide smooth, trouble free performance when moving an outrigger outboard for fishing or moving it inboard for stowage.

3. Such devices that can operate with straight, untrussed poles or with trussed poles generally of about 15 to 23 foot length.

4. Such devices that enable quick movement of the outrigger pole from a inboard storage position to an outboard trolling position and vis versa.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of an outrigger device for use with a fishing boat having gunwale or other rigid surface upon which the device can be mounted for movement between different positions, e.g., an inboard storage position and an outboard trolling position.

The outrigger device basically comprises (a) a receptacle tube to carry an outrigger pole, (b) a mount unit, (c) a standard tube, (c) pivot means for enabling up and down positioning of the receptacle tube and (d) bifurcated lock means to control inboard/outboard swinging movement of the receptacle tube.

The mount unit including a plate for attachment to surface. The plate has a central circular opening through which the standard tube extends with its longitudinal axis normal to the plate and the standard tube 28 rotatable relative to the plate and its central opening.

The mount unit also has a guide tube of circular cross-section and its top end is fixed normal to the plate and concentric with the central plate opening. Such guide tube surrounds the lower end portion of the standard tube.

The pivot means includes first and second rotation members that comprise tubular base sections. Lug sections extend axially from the inside ends of the base sections and have mating surfaces containing radial grooves. Clamp means releasably locks together the mating surfaces permitting the rotation members to move relative to one another to raise or lower the receptacle tube and outrigger pole.

The bifurcated lock means comprises a pair of arcuate members that clamp around a circular collar that is fixed to the standard tube and a cam unit that is operated by a handle to tighten or loosen the arcuate members clamping of the collar.

To move the outrigger pole laterally from one position to another, e.g., from an inboard, stowage position to an outboard trolling position, the fisherman pulls the handle down and away from the standard tube. This unclamps the to enable the receptacle tube and outrigger pole to swing into the new, desired position.

To elevate or lower the outrigger pole, the fisherman, while holding onto receptacle tube, untightens the pivot-unit whereupon the outrigger pole may be moved up or down as desired.

BRIEF DESCRIPTION OF THE DRAWINGS

A more complete understanding of the invention can be obtained by reference to the accompanying drawings in which.

DESCRIPTION OF THE PREFERRED EMBODIMENTS

Figures 1, 14, 25:
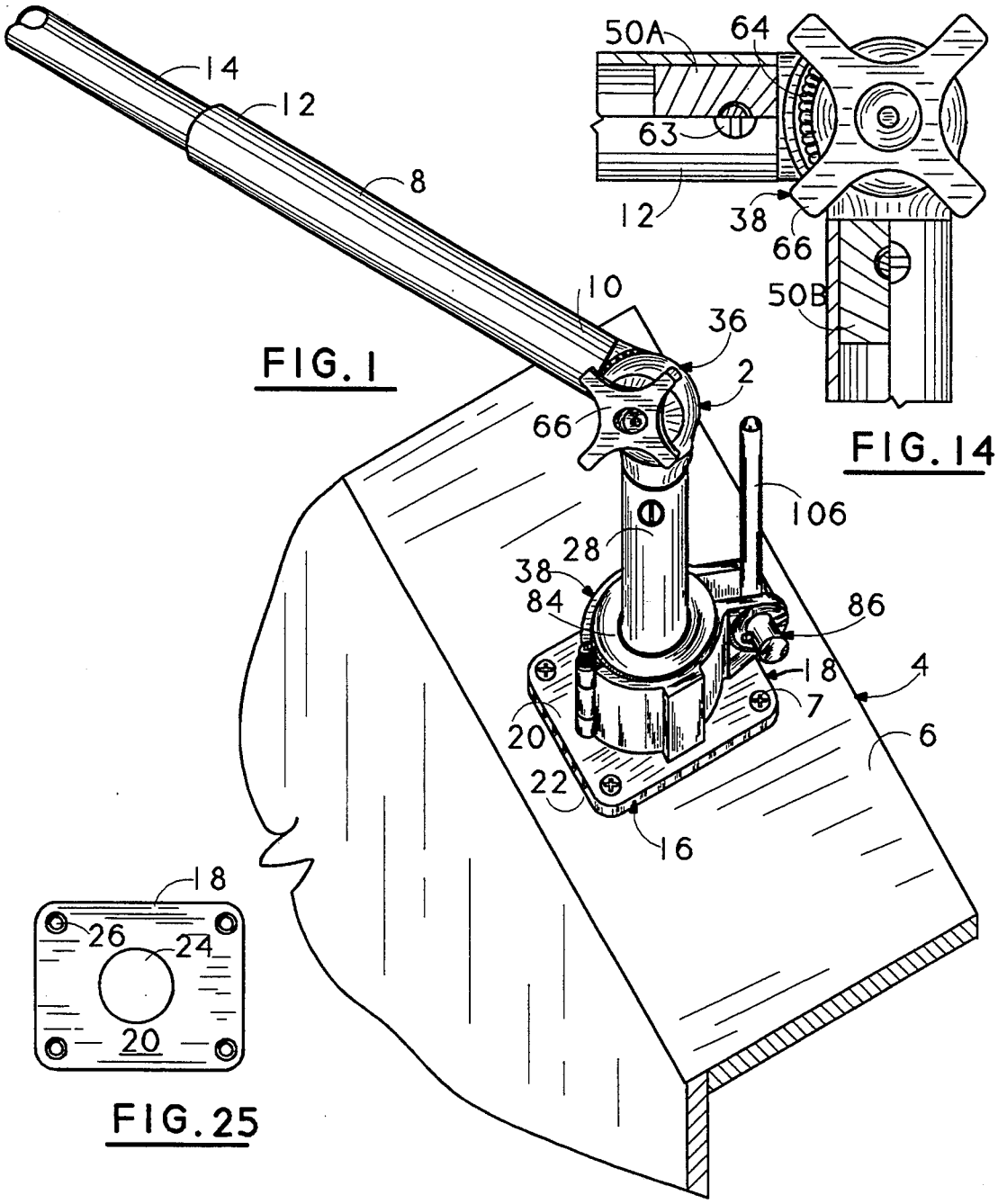
FIG. 1 is an isometric view of an outrigger device of the invention mounted on a fishing boat.
FIG. 14 is a fragmentary, partially sectioned, lateral view of the pivot means of the outrigger device of FIG. 1.
FIG. 25 is a plan view of the plate of the mount unit of the outrigger device of FIG. 1.
Figures 2, 3, 4, 5, 6, 7, 8:
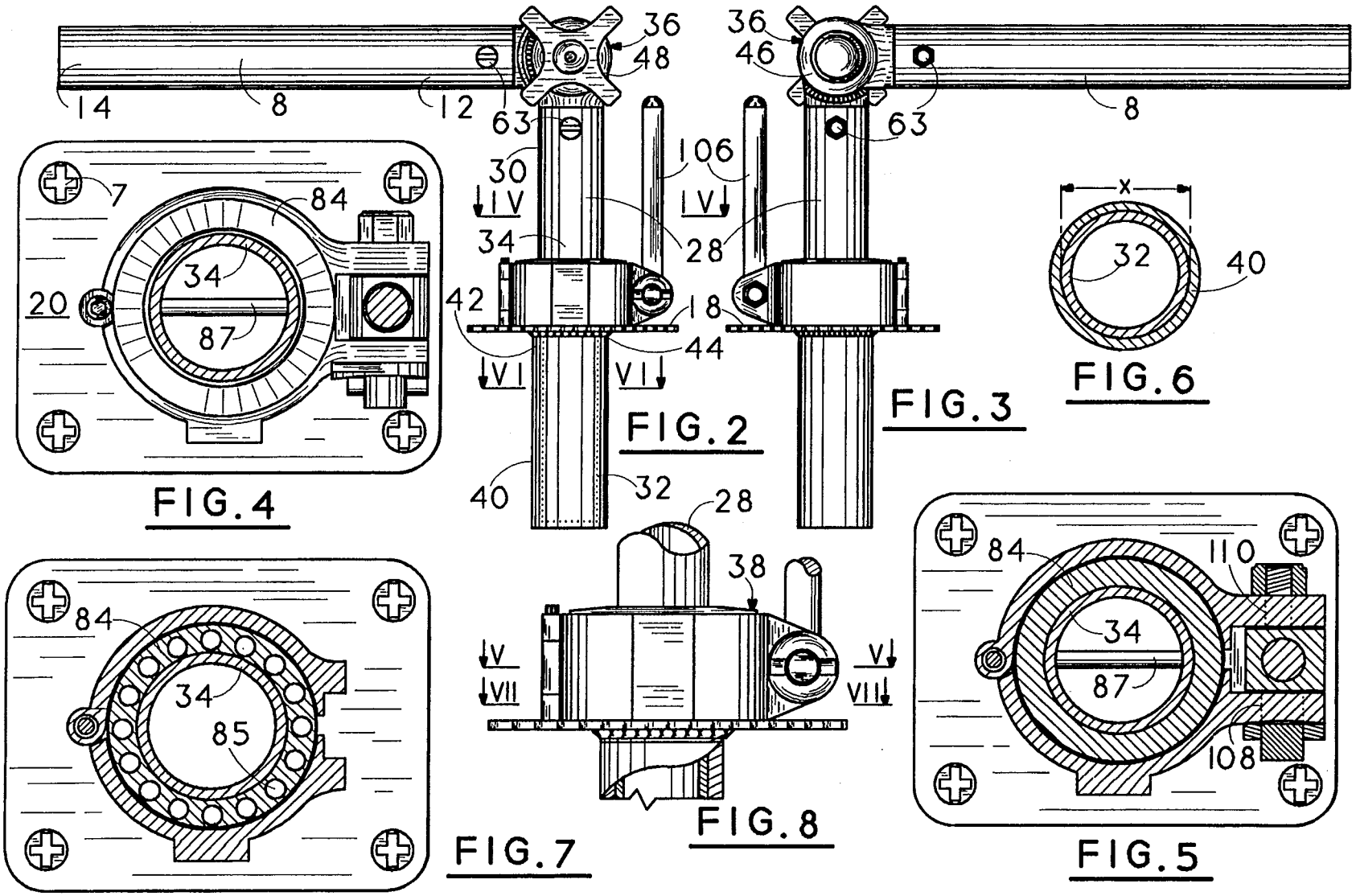
FIG. 2 is a first elevational view of the outrigger device of FIG. 1.
FIG. 3 is a second elevational view of the outrigger device of FIG. 1.
FIG. 4 is a sectional view taken on the line IV—IV of FIG. 2.
FIG. 5 is a sectional view taken on the line V—V of FIG. 8.
FIG. 6 is a sectional view taken on the line VI—VI of FIG. 2.
FIG. 7 is a sectional view taken on the line VII—VII of FIG. 8.
FIG. 8 is an enlarged, fragmentary, partially sectioned view of the lock means of the outrigger device of FIG. 1.

Referring in detail to the drawings in which identical parts are identically numbered, the outrigger device 2 for use with a fishing boat 4 having a support surface 6 upon which device 2 is mounted by fasteners 7 for movement between various positions comprises a receptacle tube 8 defined by an inboard end 10 and an outboard end 12 to carry an outrigger pole 14.

Device 2 also comprises a mount unit 16 including a plate 18 for attachment to surface 6 by fasteners 7. Unit 16 is defined by parallel top and bottom surfaces 20 & 22 respectively. Plate 18 has a central circular opening 24 and bevelled fastener holes 26 extending therethrough.

Device 2 further comprises a standard tube 28 defined by an upper end portion 30, a lower end portion 32 and a central portion 34. The central portion 34 extends through the plate opening 24 with its longitudinal axis normal to the surfaces 20 & 22 and the standard tube 28 is rotatable relative to the plate 18 and its opening 24.

Device 2 still further comprises pivot means 36 for enabling angled positioning of tube 18 relative to the horizon and bifurcated lock means 38 for controlling the rotation of the standard tube 28.

The mount unit 16 has a guide tube 40 of circular cross-section with an X length inside diameter. Top end 42 of tube 40 is fixed to plate 18, such as by welding 44, normal to the plate surfaces 20 & 22 and concentric with the plate opening 24. Tube 40 surrounds the lower end portion 32 of the standard tube 28.

The pivot means 36 includes first and second rotation members 46 & 48 respectively, that comprise tubular base sections 50A & 50B defined by an outside ends 52A & 52B and inside ends 54A & 54B. Lug sections 56A & 56B extend axially from the inside ends 54A & 54B respectfully separated by ledges 57A & 57B and have mating surfaces 58A & 58B defined by a plane MS, a circular periphery 60 and a central opening 62A or 62B.

Base section 50A of member 46 telescopes into end 10 of tube 8 and is fixed therein by fastener 63. Base section 50B of member 48 telescopes into end 30 of tube 28 and is fixed therein by another fastener 63.

The mating surfaces 58A & 58B contain a multitude of radial grooves 64 therein extending from the periphery 60 toward the central polygonal opening 62A or circular opening 62B.

Clamp means 66 to lock together the mating surfaces 58A & 58B consists of a carriage bolt 68 and a massive wing nut 70.

Figures 9, 10, 11, 12, 13, 15, 16, 17, 18, 19, 20, 21, 22, 23, 24:
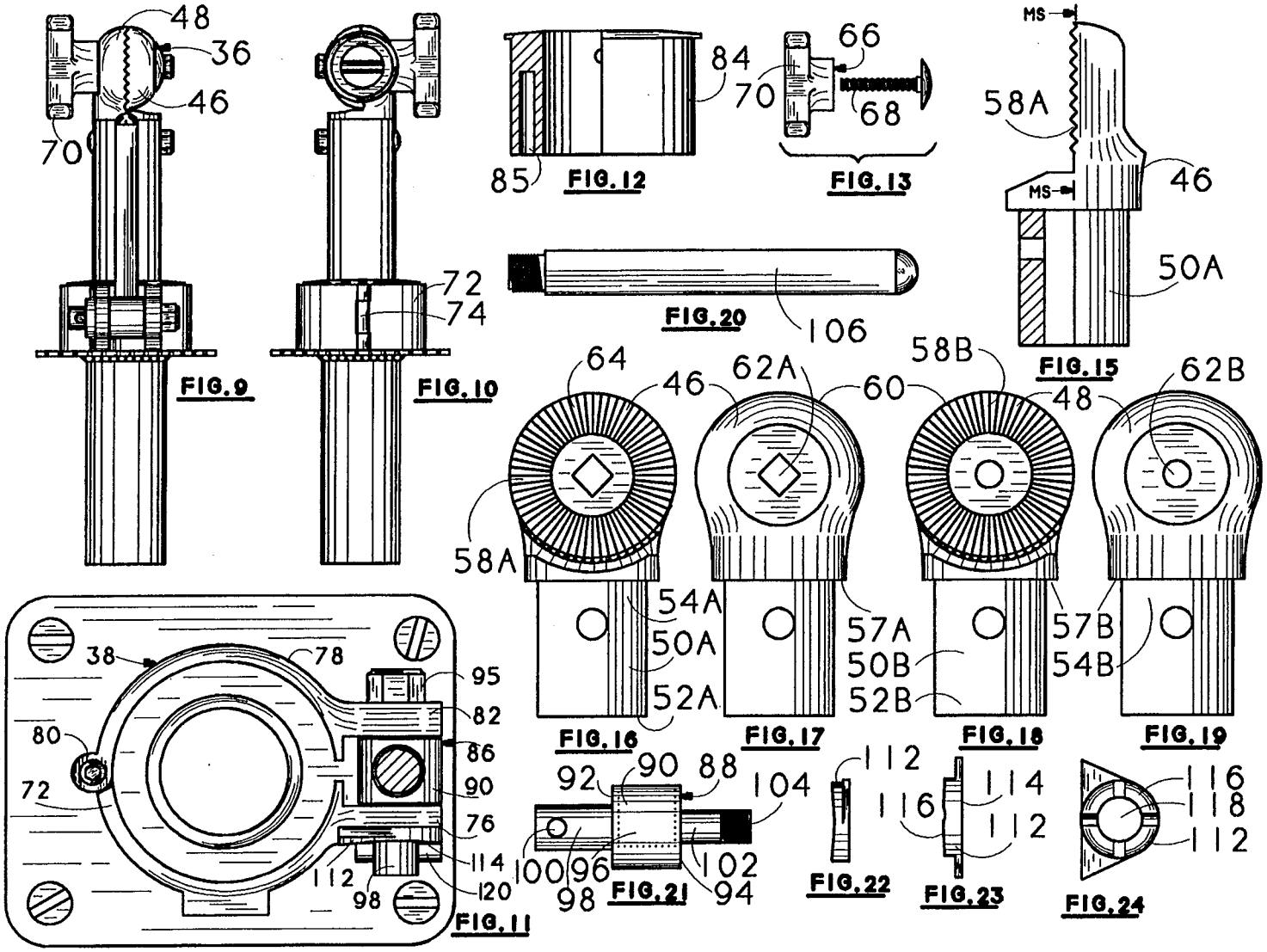
FIG. 9 is a third elevational view of the outrigger device of FIG. 1.
FIG. 10 is a fourth elevational view of the outrigger device of FIG. 1.
FIG. 11 is an enlarged plan view similar to the view of FIG. 4 with upper portions of the outrigger device removed.
FIG. 12 is a lateral, partially sectioned view of a member of the lock means removed from the remainder of the outrigger device.
FIG. 13 is an expanded, lateral view of first and second parts of the pivot means of the outrigger device of FIG. 1.
FIG. 15 is a first lateral view, partially sectioned, of a third part of the pivot means of the outrigger device of FIG. 1.
FIGS. 16 & 17 are second and third lateral views of the third part of the pivot means.
FIGS. 18 & 19 are first and second lateral views of a fourth part of the pivot means of the outrigger device of FIG. 1.
FIG. 20 is a lateral view of a handle part of the lock means of the outrigger device of FIG. 1.
FIG. 21 is a lateral view of a bolt part of the lock means of the outrigger device of FIG. 1.
FIG. 22 is a top view of a cam part of the lock means of the outrigger device of FIG. 1.
FIG. 23 is a side view of the cam part of FIG. 22.
FIG. 24 is a plan view of the cam part of FIG. 22.

Bifurcated lock means 38 comprises arcuate member 72 with a hinge portion 74 and opposed lug portion 76, arcuate member 78 with hinge portion 80 and an opposed lug portion 82 plus a circular collar 84 (see FIG. 12) and a cam unit 86.

The collar 84 contains relief bores 85 and is fixed to standard tube 28 by pin 87.

The cam unit 86 comprises a bolt member 88 with a cylindrical middle portion 90 having a first side 92, a second side 94 and a threaded radial bore 96. A cylindrical axle member 98 projects axially from the side 92 and has a transverse bore 100 therein. Also, a cylindrical axle member 102 with a threaded end 104 projects axially from side 94 and receives nut 95.

Cam unit 86 further comprises a handle 106 threaded into the radial bore 96 of middle portion 90.

To functionally accommodate bolt member 88, there are axially aligned bearing bores 108 and 110 in the lug portions 76 & 82 respectively. The bore 108 rotatably carries the axle member 98 and the bore 110 rotatably carries the axle member 102.

The cam unit 86 further comprises a cam plate 112 having a plane surface 114, a cam surface 116 and central bore 118. The plane surface 114 contacts lug portion 76 with the central bore 118 axially aligned with bearing bore 108.

The transverse bore 100 of the axle member 98 carries pin 120 that slidably rides against the cam surface 116 of the cam plate 112.

When properly mounted on a fishing boat, use of the outrigger device is quick and simple. To move the outrigger pole 14 from one position to another, e.g., from an inboard, stowage position to an outboard trolling position, the fisherman simply pulls the handle 106 down and away from the standard tube 28. This unclamps the collar 84 to enable the tube 8 and pole 14 to swing into the new, desired position whereupon the handle 106 is returned to its upright position to clamp collar 84 and lock tube 8 and pole 14 in the new position.

To elevate or lower the pole 14 anywhere between a vertical and horizontal position, the fisherman, while holding onto tube 8, turns wing nut 66 to untighten it on bolt 68 until grooves 64 of rotation members 46 & 48 can slide past each other, whereupon tube 8 and pole 14 are moved up or down as desired. As soon as such movement is completed, wing nut 66 is retightened to lock tube 8 and pole 14 in the new position.

I claim:

1. An outrigger device for use with a fishing boat having a support surface upon which said device can be mounted for movement between various positions including an inboard storage position and an outboard trolling position, said device comprising:

an outrigger pole receptacle tube defined by an inboard end and an outboard end, a mount unit including a plate for attachment to said support surface defined by parallel top and bottom surfaces, said plate having a circular opening extending through said surfaces, a standard tube defined by a first longitudinal axis, an upper end portion, a lower end portion and a central portion, said central portion extending through said plate opening with said first longitudinal axis normal to said surfaces and said standard tube being rotatable about said axis relative to said opening, pivot means mounting said receptacle tube to said standard tube for angled positioning therebetween, and bifurcated lock means for preventing rotation of said standard tube relative to said opening.

2. The outrigger device of claim 1 wherein said pivot means includes first and second rotation members each comprising:

a tubular base section defined by a third longitudinal axis, an outside end and an inside end and a lug section extending axially from said inside end and having a mating surface defined by a plane parallel to said third longitudinal axis, and clamp means to lock said mating surface of said first rotation member to said mating surface of said second rotation member.

3. The outrigger device of claim 2 wherein said mating surface is defined by a circular periphery and a central opening.

4. The outrigger device of claim 3 wherein said mating surface contains a multitude of radial grooves therein extending from said periphery toward said central opening.

5. The outrigger device of claim 4 wherein said central opening in said first rotation member is polygonal and in said second rotation member is circular.

6. The outrigger device of claim 2 wherein a ledge separates said tubular base section from said lug section.

7. The outrigger device of claim 2 wherein said clamp means consists of a carriage bolt and a wing nut.

8. The outrigger device of claim 1 wherein said mount unit has a guide tube defined by a second longitudinal axis and first circular cross-section with a first length inside diameter, said guide tube depending from said plate with said second longitudinal axis normal to said plate surfaces and concentric with said plate opening, said guide tube surrounding said lower end portion of said standard tube.

9. The outrigger device of claim 8 wherein said standard tube has a second circular cross-section with a second length outside diameter slightly less than said first length inside diameter.

10. An outrigger device for use with a fishing boat having a support surface upon which said device can be mounted for movement between various positions including an inboard storage position and an outboard trolling position, said device comprising:

an outrigger pole receptacle tube defined by an inboard end and an outboard end, a mount unit including a plate for attachment to said support surface defined by parallel top and bottom surfaces, said plate having a circular opening extending through said surfaces, a standard tube defined by a first longitudinal axis, an upper end portion, a lower end portion and a central portion, said central portion extending through said plate opening with said first longitudinal axis normal to said surfaces and said standard tube being rotatable about said axis relative to said opening, pivot means mounting said receptacle tube to said standard tube for angled positioning therebetween, and bifurcated lock means for preventing rotation of said standard tube relative to said opening which comprises:

a first arcuate member defined by a first hinge portion and an opposed first lug portion and a second arcuate member defined by a second hinge portion and an opposed second lug portion, a circular collar positioned between said first and second arcuate members and a cam unit carried by said first and second lug portions.

11. The outrigger device of claim 10 wherein said cam unit comprises:

a bolt member defined by a fourth longitudinal axis and a cylindrical middle portion having a first side, a second side and a threaded radial bore therein, a cylindrical first axle member projecting axially from said first side of said middle portion and having a transverse bore therein and a cylindrical second axle member having a threaded end and projecting axially from said second side of said middle portion.

12. The outrigger device of claim 11 wherein said cam means further comprises a handle threaded into said threaded radial bore of said middle portion.

13. The outrigger device of claim 11 wherein there are first and second axially aligned bearing bores respectively in said first and second lug portions, said first bearing bore rotatably carries said first axle member and said second bearing bore rotatably carries said second axle member.

14. The outrigger device of claim 11 wherein said cam unit further comprises a cam plate defined by a plane surface, a cam surface and central bore extending between them.

15. The outrigger device of claim 14 wherein said plane surface of said cam unit contacts said first lug portion with said central bore of said cam unit axially aligned with said first bearing bore of said first lug portion.

16. The outrigger device of claim 15 wherein said transverse bore of said first axle member carries a pin that slidably rides against said cam surface of said cam plate.

17. The outrigger device of claim 16 wherein said threaded end of second axle member extends through said second bearing bore and is captured therein by a nut threaded onto said threaded end.

18. An outrigger device for use with a fishing boat having a support surface upon which said device can be mounted for movement between various positions including an inboard storage position and an outboard trolling position, said device comprising:

an outrigger pole receptacle tube defined by an inboard end and an outboard end;

a mount unit including a plate for attachment to said support surface defined by parallel top and bottom surfaces, said plate having a circular opening extending through said surfaces;

a standard tube defined by a first longitudinal axis, an upper end portion, a lower end portion and a central portion, said central portion extending through said plate opening with said first longitudinal axis normal to said surfaces and said standard tube being rotatable about said axis relative to said opening;

a guide tube depending from said plate normal to said plate surfaces and concentric with said plate opening, said guide tube surrounding said lower end portion of said standard tube;

pivot means mounting said receptacle tube to said standard tube for angled positioning therebetween comprising first and second rotation members and clamp means to lock said first rotation member against said second rotation member; and bifurcated lock means for preventing rotation of said standard tube relative to said opening comprising a first arcuate member defined by a first hinge portion and an opposed first lug portion and a second arcuate member defined by a second hinge portion and an opposed second lug portion, a circular collar that surrounds said standard tube and is clamped between said first and second arcuate members and a cam unit carried by said first and second lug portions to move said arcuate members relative to one another.

* * * * *